United States Patent [19]

Alexanian

[11] Patent Number: 4,716,490

[45] Date of Patent: Dec. 29, 1987

[54] POWER SAVING MODULE

[76] Inventor: George Alexanian, 6138 N. Brooks Cir., Fresno, Calif. 93711

[21] Appl. No.: 33,622

[22] Filed: Apr. 3, 1987

[51] Int. Cl.[4] ..... H01H 47/04; H01H 47/22

[52] U.S. Cl. ..... 361/155; 361/194; 361/195

[58] Field of Search ..... 361/155, 194, 195

[56] References Cited

U.S. PATENT DOCUMENTS 2,182,637 12/1939 Marbury ..... 361/195
2,483,408 10/1949 Garber ..... 361/195

FOREIGN PATENT DOCUMENTS 0252012 9/1948 Switzerland ..... 361/155

*Primary Examiner*—L. T. Hix
*Assistant Examiner*—David Porterfield

[57] ABSTRACT

A new method of activating existing electric solenoids which reduces the power required up to 90%, reduces the size of wire required, extends solenoid life, and facilitates installation. This is accomplished by adding an encapsulated module at the end of the electrical line just ahead of the solenoid. The principles used are that a solenoid requires a much higher level of energy to actuate than to keep it actuated. Charging a capacitor slowly then allowing it to suddenly discharge into the coil eliminates the inrush load demanded on the source, while a series resistance then keeps the load at a low level by acting as a current limiter.

5 Claims, 3 Drawing Figures

POWER SAVING MODULE

BACKGROUND OF INVENTION

Hard wired irrigation systems are based on a 24 volts AC RMS (VAC) supply and use a common to the valves plus one control wire to each solenoid. Frequently, several solenoid valves are required to be operated simultaneously. In large turf and agricultural applications, the length of the runs of wire from the controller to the solenoid can be as long as 15,000 feet (round trip). All solenoids require a minimum level of voltage and current for proper operation. A 24 Volt AC (VAC) solenoid can require typically 20 VAC (volts AC) at 0.45 amps inrush current for small valves (3 inch and under) and as much as 1.5 amps for larger valves. The problem is that these current loads cause a voltage drop between the controller and the solenoids. This is calculated by the equation:

$$V_D = I \times R \times L$$

$V_D$=voltage drop in volts
I=current load in amps
R=resistance factor (ohm/1000 ft.)
L=length of wire in thousands of feet
For 14 gauge solid copper wire, R=2.5 ohms/1000 ft.
For 12 gauge solid copper wire, R=1.588 ohms/1000 ft.
For 10 gauge solid copper wire, R=1.0 ohms/1000 ft.
For 8 gauge solid copper wire, R=0.628 ohms/1000 ft.
For 6 gauge solid copper wire, R=0.395 ohms/1000 ft.

For an example, an inrush load of one amp at 5000 feet using 14 gauge wire should cause a voltage drop of:

$$V_D = 1\text{amp} \times 2.5 \times 5 = 12.5 \text{ volts.}$$

Typically, there is a 24 VAC supply at the controller. By the time the solenoid is reached, 24−12.5 volts=11.5 volts is available. Normally about a minimum of 20 VAC is required for reliable operation.

Going to 12 gauge would give us a drop of: $V_D = 1 \times 1.588 \times 5 = 7.94$ volts. This would be about 16 volts, still not enough.

Going to 10 gauge would give us a drop of: $V_D = 1 \times 1 \times 5 = 5$ volts. Since this is still less than 20 VAC, 8 gauge would be required.

For a cost analysis, 14 gauge costs about $28.00 per 1000 feet. 8 gauge wire costs about $135 per 1000 feet. A net cost difference of $107.00 per 1000 feet×5=$535 per value. If there are 20 valves on this job, several thousand dollars of wire would be required. In addition, handling of the heavier 8 gauge is more difficult than direct burial 14 gauge. With the module, three basic problems are overcome: high cost, difficult installation, and high energy requirements.

SUMMARY OF INVENTION

The POWER SAVING MODULE is an accessory to electric solenoids used in the irrigation industry that reduces the power draw from 70% to 90%. The most dramatic result of this power saving is to allow the use of 14 gauge direct burial wires almost exclusively in the irrigation industry, which results in considerable cost savings. The principle of operation is two-fold:

1. Eliminate the inrush current demanded from the source by AC operated solenoids.
2. Once the solenoid has been actuated, to keep it energized with a lower level of voltage and current.

The module would be mounted at the end of the electrical leads directly ahead of the solenoid. The 24 volts AC from the controller is converted in the module to DC voltage and the result is a much more efficient and cost effective solenoid.

DETAIL OF PREFERRED EMBODIMENT

The following facts about solenoid valves lead to the invention as a solution:

1. Only AC current can be reliably transmitted underground.
2. AC solenoids can be operated by DC current as long as the power dissipated by the coil does not overheat the coil.
3. Solenoids normally require about 20 volts to operate but only need about 3 volts DC to keep energized.

Figure 1:
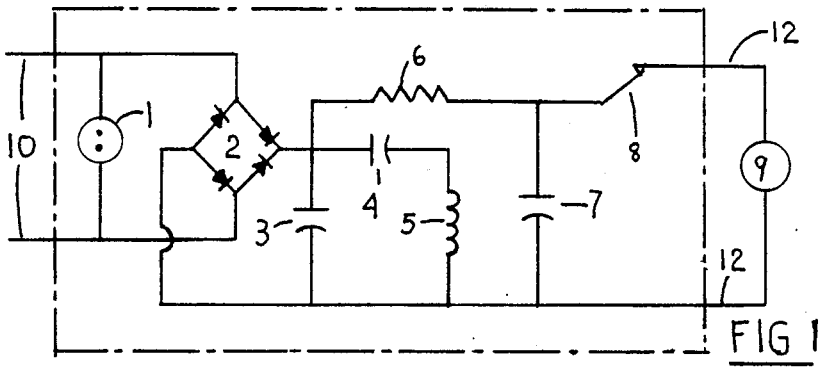
FIG. 1 is a preferred circuit of the POWER SAVING MODULE.

So the solution is to supply a high voltage to a solenoid which does not load the circuit, then switch to a lower "holding" voltage and current that does not overheat the coil. In FIG. 1, the preferred schematic of the module is displayed.

The 24 VAC RMS from the controller is shunted by spark gap 1 which is a transient deterrent device. This spark gap is a gas filled component which discharges when an excessive voltage develops across the 24 VAC RMS input, such as during a lightning storm. This device protects both the module and solenoid during such surges.

The 24 volts AC RMS goes to full wave bridge rectifier 2 and capacitor 3 which converts to about 35 VDC (volts DC). Instantaneously capacitor 4 is shorted, which energizes the relay 5 for about four time constants (about 2 seconds). During this time capacitor 7 is being charged through resistance 6 such that it is over 90% charged by the time that relay 5 is de-energized because capacitor 4 is now nearly an open circuit. When contact 8 returns to its normally closed position, the charge built up on capacitor 7 discharges across solenoid coil 9 which is of sufficient amplitude and duration to pull in the solenoid. Once activated, the current flows through resistor 6 is sufficient to keep the solenoid energized.

In an alternate embodiment, the relay circuit that provides a delay of about 2 seconds to allow the capacitor to charge can be substituted by a zener diode —TRIAC combination that does the same function as the relay. However, the relay approach is preferred because electro-mechanical components are much less susceptible to damage caused by high-voltage transients caused by lightning storms.

Figure 2:
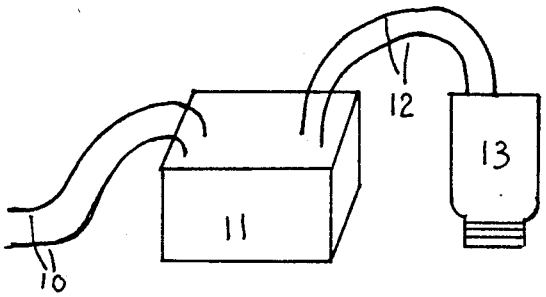
FIG. 2 shows the module as it would be typically attached to an electric solenoid.

In FIG. 2, module 11 is attached by two short leads to the electric solenoid 13.

Figure 3:
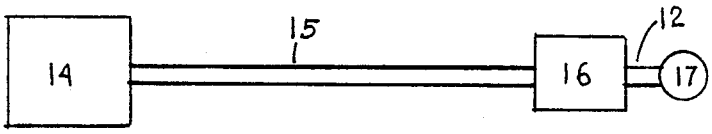
FIG. 3 shows the relative positions of the irrigation controller, module, and solenoid.

In FIG. 3, the Power Saving Module 16 is located at the solenoid 17, frequently several thousand feet away from the 24 VAC RMS source or irrigation controller 14. This is because the module converts the AC to DC and it is not desirable to bury wires carrying DC current because of the deteriorating effect on the copper wires.

CONCLUSION

This concept can be used for either 12 or 24 volts systems on 12 and 24 VDC, or 24 VAC solenoids which can be 2 or 3 way normally open or closed solenoid actuators or pilot valves. The two key factors are to use 24 VAC and convert to DC at the valve and to use the high pull in voltage to low holding voltage as a tool to minimize the load on the controller voltage.

I claim:

1. A device for energizing a solenoid comprising:

a DC power source means, normally closed switch means and means for connecting said switch means in series with a solenoid, a first capacitor connected in parallel with said switch means and said solenoid when said solenoid is connected to said switch means, resistance means connected to a terminal of said DC power source means and to a junction of said first capacitor and said switch means, time delay means comprising a second capacitor connected in series with a relay coil across said DC power source means, said relay coil controlling said switch means, wherein, upon application of power from said DC power source means, current flows through said second capacitor and said relay coil and thereby opens said switch means and current flows through said resistance means to charge said first capacitor, and whereby upon charging of said second capacitor, and relay becomes de-energized and said switch means closes to permit, when said solenoid is connected to said switch means, an initial high current to flow from said first capacitor through said solenoid and thereafter permit a low-level holding current to flow from said DC power source means to said solenoid through said resistance means.

2. The device according to claim 1 wherein said DC power source means comprises:

a full-wave rectifier with inputs adapted to be connected to a source of AC power, and a third capacitor connected across the outputs of said rectifier.

3. The device according to claim 3 wherein said device is protected from high energy transients by a spark gap device connected across said full wave rectifier inputs.

4. The device according to claim 1, 2 or 3 wherein said device is encased in a module to be placed at the solenoid end of existing AC control lines in order to control said solenoid by selective energization of said AC control lines.

5. The device according to claims 1, 2 or 3 including said solenoid connected to said switch means.

* * * * *